United States Patent [19]

Silbermintz

[11] Patent Number: 4,474,371

[45] Date of Patent: Oct. 2, 1984

[54] MANIPULATIVE TILE GAME

[76] Inventor: Marvin A. Silbermintz, 141-24 70th Ave., Kew Gardens Hills, N.Y. 11367

[21] Appl. No.: 337,871

[22] Filed: Jan. 7, 1982

[51] Int. Cl.[3] ..... A63F 9/00

[52] U.S. Cl. ..... 273/1 G

[58] Field of Search ..... 273/1 G, 1 GE, 1 GF, 273/153 S, 273, 144 B, 145 C, 121 R, 123 R, 281

[56] References Cited

U.S. PATENT DOCUMENTS

| | | | |
|---|---|---|---|
| 730,026 | 6/1903 | Keedell | 273/153 S |
| 3,623,723 | 11/1971 | Helbach | 273/1 G |
| 4,114,877 | 9/1978 | Goldfarb et al. | 273/1 GF |
| 4,210,324 | 7/1980 | Morrison et al. | 273/1 G |

FOREIGN PATENT DOCUMENTS

| | | | |
|---|---|---|---|
| 124550 | 6/1947 | Australia | 273/153 S |
| 589891 | 12/1933 | Fed. Rep. of Germany | 273/121 R |
| 451086 | 2/1913 | France | 273/123 R |
| 480930 | 7/1916 | France | 273/123 R |
| 387221 | 2/1933 | United Kingdom | 273/153 S |
| 394052 | 12/1973 | U.S.S.R. | 273/273 |

OTHER PUBLICATIONS

Lakeside Toys Catalog, 3/1966, Topper No. 8314.
Games and Puzzles, 4–1977, p. 26, Boggle.

*Primary Examiner*—Paul E. Shapiro

[57] ABSTRACT

A game comprising a first device for establishing a pattern of different indicia, including nine colored faces, and a second device having a plurality of square colored tiles of the same colors and greater than the number of colored faces. The tiles fit in a tray having an area greater than all the tiles by at least the area of one tile. Players attempt to match the pattern of colors on the first device by manipulating the tiles in the tray. A mask is provided for placement over the tray to cover all but nine of the tiles located in a predetermined area of the tray corresponding to the area of the pattern.

11 Claims, 6 Drawing Figures

FIG. 1
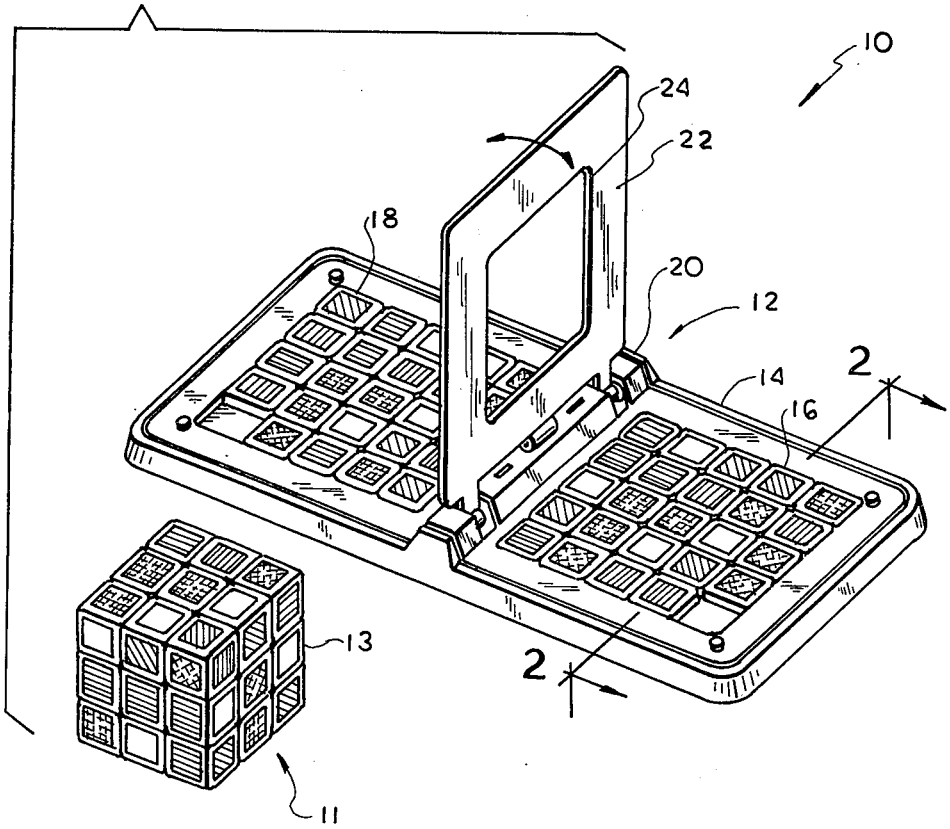
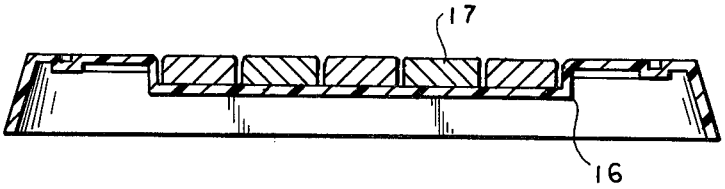
FIG. 2

MANIPULATIVE TILE GAME

The present invention relates to games, and more in particular, to a game in which the players duplicate color patterns or the like established by a separate selectively operable device.

There has recently been commercialized a very popular toy puzzle sold by Ideal Toy Corporation under the trademark "RUBIK'S CUBE." This cube puzzle consists of twenty-six individual "cubies" which are connected by a unique but known mechanism to define a larger cube that, in the start position, has a different distinct color on each side. The interconnecting mechanism for the cubies permits each layer of cubies to be rotated through 360° so that the individual cubies may be scrambled, to provide varying color patterns of cubies on each face of the cube. The object of the puzzle is to rearrange the cubies back to their original position. There are over 43 billion possible combinations of cubies in the puzzle, and it is an extremely difficult task for the average person to reassemble the puzzle to its original position, although experts have been known to be able to solve the puzzle within 24 seconds. The cube puzzle can, of course, only be operated by one person at a time, and thus, has limited play value for two individuals at the same time.

It is an object of the present invention to provide a game which provides competition between players in duplicating patterns established by a cube puzzle or the like.

Another object of the present invention is to provide a game which requires dexterity and visual perception by the players in duplicating preestablished color patterns.

Yet another object of the present invention is to provide a game which is relatively simple in construction and durable in use.

A further object of the present invention is to provide a game having substantial play value for use in conjunction with a cube puzzle or the like.

In accordance with an aspect of the present invention, a game is provided which includes means for establishing a pattern of different colors and a separate tray providing support for a plurality of tiles also having separate colors therein which are movable to varying positions to enable the players to reproduce color patterns established on one side of the cube puzzle. More in particular, the game includes a cube puzzle, such as, for example, is sold under the trademark "RUBIK'S CUBE" by Ideal Toy Corporation, which can be operated so that one selected face of the cube puzzle presents a pattern of nine different squares of colors. The tray has a pair of recesses containing a plurality of movable tiles thereon, with the tiles consisting of groups of different colored tiles. These tiles can be moved in the recesses by two players, in a competition to determine which player can reproduce the pattern established on the cube puzzle first. Preferably, more tiles are provided in each recess of the tray than there are cubies on the cube face and a movable mask is provided so that the players, when they have established the required pattern on a predetermined area of the tray, can mask out the other tiles on the tray to determine whether they have, in fact, properly reproduced the established pattern in the required area, thereby to determine the winner of the game.

The above, and other objects, features and advantages of this invention will be apparent from the following detailed description of an illustrative embodiment thereof, which is to be read in connection with the accompanying drawings wherein:

FIG. 1 is a perspective view of one embodiment of the game of the present invention;

FIG. 1*a* is a perspective view of another form of device for establishing a color pattern;

FIG. 1*b* is an exploded perspective view of the device shown in FIG. 1*a;*

FIG. 2 is a sectional view taken along 2—2 of the tray shown in FIG. 1;

Figure 1A:
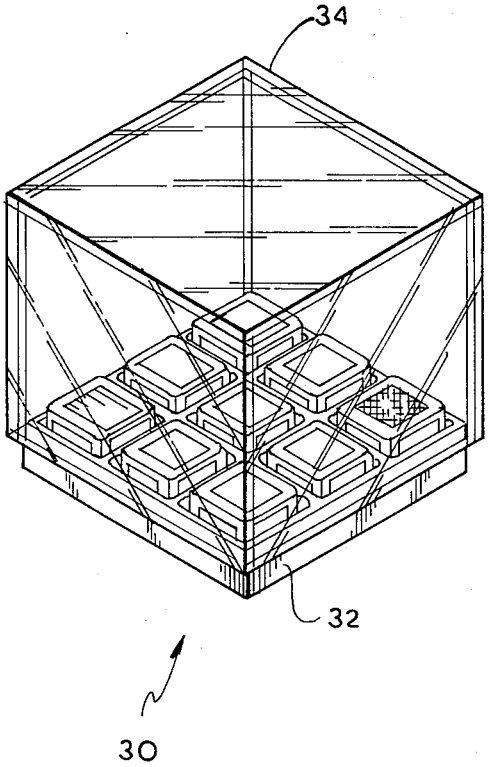

Referring now to the drawings in detail, and initially to FIG. 1 thereof, the game 10 consists of a cube puzzle 11 and a tray structure 12. The cube puzzle is of the type sold by Ideal Toy Corporation under the trademark "RUBIK'S CUBE." It consists of twenty-six cubies 13 providing a larger cube, which in the start position, has each face of the cube formed with a different color. The color may be supplied by vinyl, adhesive labels or the like. The faces of the different cubies in the puzzle shown in FIG. 1 are cross-hatched to represent different colors, i.e. red, blue, green, orange, yellow and white.

As is known, the different layers of the cube can be rotated in order to scramble the different cubies, thereby to create different patterns of colors on each face of the cube.

In the play of the game, the players first manipulate the cube puzzle to scramble the cubies thereon and establish on one face a pattern of colored cubies. It is an object of the game then to reproduce the pattern with the elements of tray 12.

Tray 12 consists of a base 14 having generally square recesses 16, 18 therein. Each recess contains twenty-four tiles 17 which can be moved about in order to reproduce the color patterns on the selected cube face.

More in particular, each recess 16, 18 contains twenty-four 17 tiles which are divided into six groups of four tiles each. Each group has color adhesive labels thereon, so that the six colors of the cube are represented on four tiles each in the respective recesses. The area of recesses 16, 18 in the tray is equal to the area of twenty-five tiles, so that the recesses define an area which can contain five rows and columns of tiles. However, only twenty-four tiles are present in each recess so that the tiles can be moved about in the recesses by sliding them about. This is in the manner similar to the very famous Lloyd's number game. Accordingly, the arrangement of the tiles can be adjusted and varied to reproduce varying color patterns therein by sliding the tiles in their recesses.

The two recesses or wells 16, 18 are separated by a dividing abutment 20 on which a mask 22 is pivotally mounted. The mask has a central opening 24 formed therein which has an area equal to the area of nine tiles, contained within the central area of each recess. The mask is pivotally mounted on abutment 20 in any convenient manner, and that construction, therefore, need not be described in detail. As the area of mask opening 24 defines an area equal to nine tiles, it will mask out the remainder of the tiles in a recess so that the number of tiles exposed when the mask is laid over a recess will correspond to the number of cubie faces on one side of cube puzzle 11.

Figure 3:
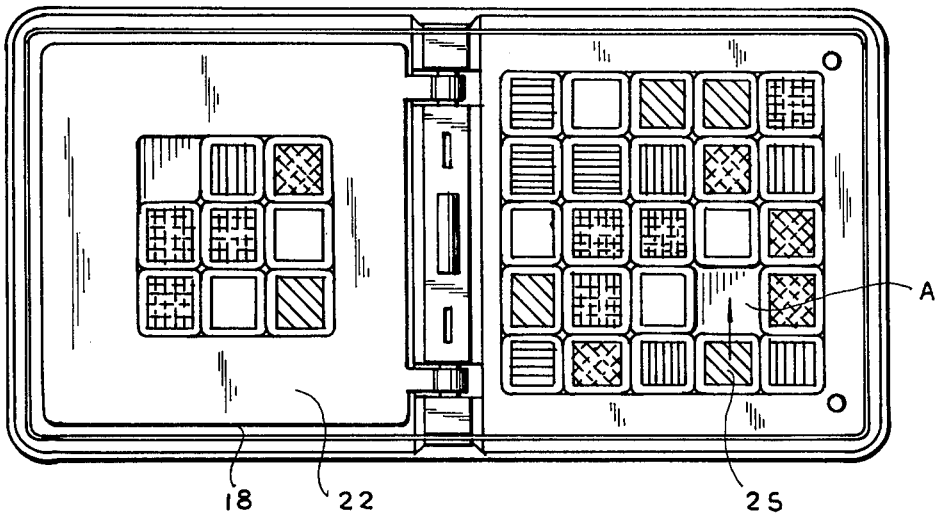
FIG. 3 is a plan view of the tray shown in FIG. 1 with the mask pivoted to one side of the tray.
Figure 4:
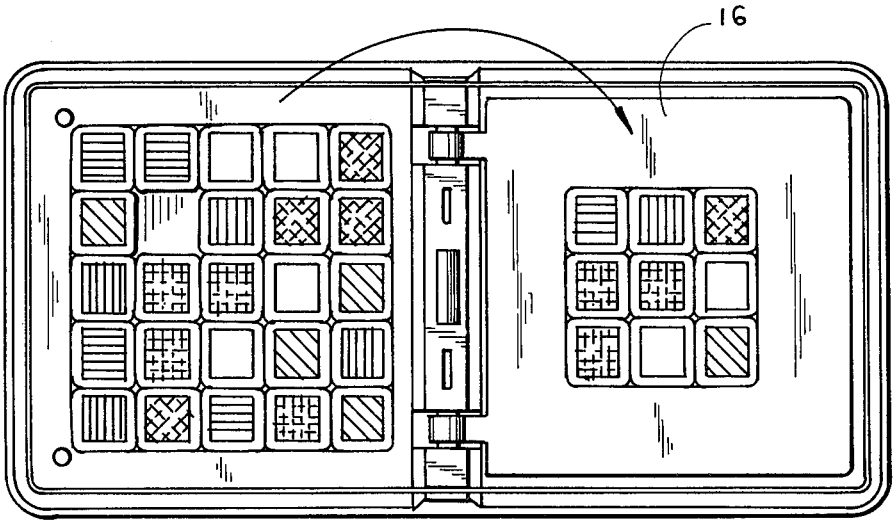
FIG. 4 is a plan view similar to FIG. 3 of the tray with the mask moved to the other side thereof.

In the play of the game, the players first scramble the cube puzzle and select one face thereof as the face which contains the established pattern. Then, with mask 22 in the raised position shown in FIG. 1, each player manipulates the tiles in their respective wells 16, 18 until the middle nine tiles contain exactly the same color pattern as that established by the selected face of the cube puzzle. When a player believes that he has established the selected pattern, he pivots mask 22 down over his associated well. If he is correct, and the other player has not duplicated the established pattern, then he is the winner. This is shown, for example, in FIGS. 3 and 4 where, in FIG. 3, mask 22 has been pivoted down over well 18 to expose only the nine central cubies in that well. As seen therein, the nine cubies in well 18 do not correspond to the pattern established in the cube puzzle of FIG. 1 and, therefore, the player operating the tiles in that recess would not be the winner. On the other hand, by the movement of one tile 25 in well 16 from the position shown in FIG. 4 in the direction of arrow A, the pattern of the nine tiles duplicates the color pattern on the cube. This is made clear by movement of mask 22 over well 16 so only the center cubies are exposed, as shown in FIG. 5, so that the player operating the tiles in that portion of the tray is the winner.

Figure 1B:
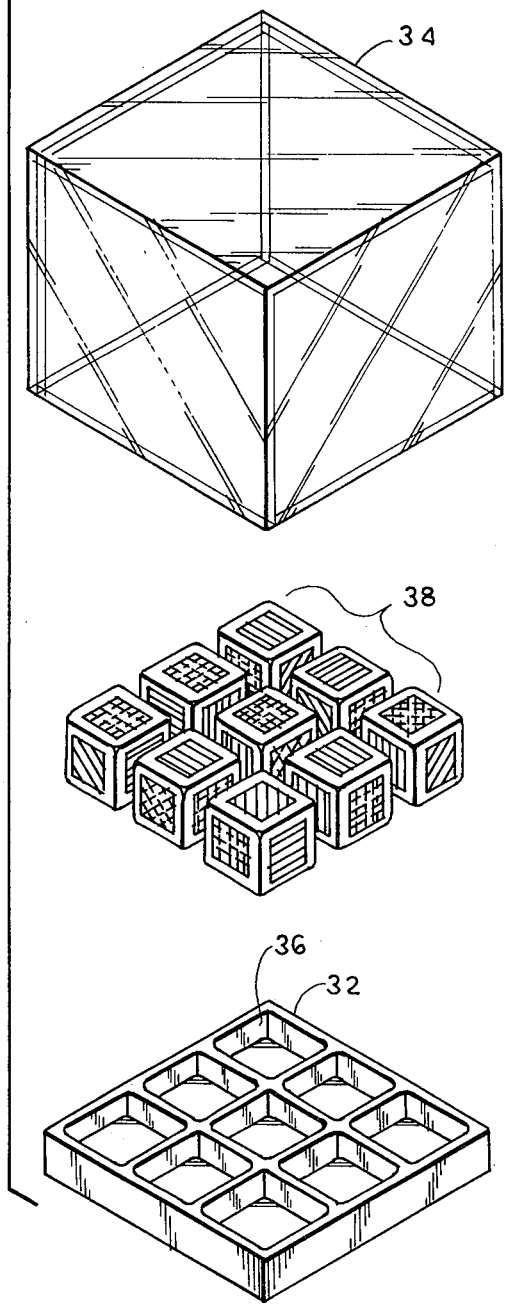

Although a cube puzzle is illustrated as the means for establishing the selected tile pattern, other devices can be used in lieu of a cube puzzle. For example, as illustrated in FIGS. 1*a* and 1*b*, a separate device 30 itself containing nine small cubes can be utilized. In this embodiment of the invention, the pattern establishing device 30 is provided which consists of a base 32 formed of plastic or the like and a transparent square cover 34 secured thereto. Nine cubes 38 are provided, as shown in FIG. 1*b*, having six faces each of which has a vinyl adhesive layer of a different color thereon. Accordingly there are fifty four different faces of the cubes 38 consisting of nine sets of faces of six different colors.

Base 32 has nine wells or recesses 36 formed therein, e.g. by molding which will receive the respective cubes 38. Cover 34 is secured to base 32 in any convenient manner, to retain the tiles therein. By shaking device 30 with the tiles therein, the tiles can be scrambled and shaken into recesses 36 to establish an upwardly exposed pattern of nine different cube faces having various color patterns thereon. Then the tiles in tray 12 would be operated by the players to duplicate the established color pattern, as described above.

It will be understood, of course, that given the random nature of the device 30 it is possible that more than four cube faces of the same color can appear in the device 30 when shaken. This situation cannot be replicated in tray 12 since there are only four tiles of each color therein. Should this occur the player simply shakes device 30 again until no more than four faces of the same color appear.

Accordingly, it is seen that a relatively simple device is provided which requires the dexterity of the players as well as visual perception in order to succeed in a competitive race type game to reproduce the established color pattern. The device provides substantial play value for a competitive game between two players, and expands the play value of a known existing product, i.e. a cube puzzle.

Although an illustrative embodiment of the invention has been described herein with reference to the accompanying drawings it is to be understood that the invention is not limited to that precise embodiment, and that various changes and modifications may be effected therein by one skilled in the art without departing from the scope or spirit of this invention.

What is claimed is:

1. A game comprising randomly adjustable means for establishing a pattern of different indicia, said pattern of different indicia including a pattern of nine colored faces; means including a plurality of movable tiles having different indicia thereon corresponding to the indicia on the first-mentioned means, for enabling a player to duplicate said established pattern by movement of said tiles, and a tray having at least one recess formed therein containing said tiles, said tiles being of uniform dimension and said recess being dimensioned to be of greater area than all of the tiles therein by a dimension substantially equal to the area of one of the tiles whereby the tiles may slide in the recess to enable the player to adjust the position thereof to correspond to the pattern established on the first-mentioned means, and said tiles in said tray recess comprise a number greater than nine; and mask means for placement over the tray to cover all but nine of the tiles therein located within a predetermined area of the tray corresponding to the area of said pattern.

2. A game as defined in claim 1 wherein there are twenty-four tiles in said recess, comprising six groups of four tiles each, with each group being a different color.

3. A game as defined in claim 2 wherein said tray has two recesses formed therein, each containing twenty-four tiles consisting of six groups of four tiles each, with each group being a different color.

4. A game as defined in claim 3 wherein said mask means is pivotally mounted on said tray between said recesses.

5. A game comprising means for establishing a pattern of different colors including a plurality of relatively movable generally square faces having a plurality of different colors distributed as indicia among said faces whereby relative movement of the faces creates varying patterns of colors; a separate tray having two generally square recesses therein, each recess containing a plurality of generally square tiles slidably positioned in the respective recess, each recess having an area which is greater than the total area of the tiles therein by an amount substantially equal to the area of one tile whereby said tiles are slidable in each respective recess to permit adjustment of the tiles relative positions and wherein there are more tiles on each of said recesses than there are faces on said first mentioned means, whereby two players may race each other in a contest to be the first to duplicate the pattern established by said first mentioned means; and mask means for selective placement over said recess for covering all tiles therein except a group equal in number to the faces in the first-mentioned means and arranged in an area of the recess corresponding to the area of said faces.

6. A game as defined in claim 5 wherein said mask is pivoted on the tray between said recesses.

7. A game as defined in claim 6 wherein said first mentioned means is a cube puzzle having six sides and formed of twenty-six interconnected cubies with the cubies on each side of the cube puzzle in its initial position being of the same color, with each side being a different color.

8. A game as defined in claim 6 wherein said first mentioned means comprises a container having a base and a transparent top, and a plurality of cubes therein having six faces with each face having a different color thereon whereby, upon shaking of the container, different color patterns are established by said tiles.

9. A game comprising randomly adjustable means for establishing a pattern of different indicia comprised of a pattern of nine colored faces with the different indicia being comprised of a plurality of different colors; means including a plurality of movable tiles having different indicia thereon corresponding to the indicia on the first-mentioned means, for enabling a player to duplicate said established pattern by movement of said tiles, the second mentioned means including a tray having at least one recess formed therein containing said tiles, said tiles being of uniform dimension and said recess being dimensioned to be of greater area than all of the tiles therein by a dimension substantially equal to the area of one of the tiles whereby the tiles may slide in the recess to enable the player to adjust the position thereof to correspond to the pattern established on th first-mentioned means, and said tiles is said tray recess comprise a number greater than nine; and mask means for placement over the tray to cover all but nine of the tiles therein located within a predetermined area of the tray corresponding to the area of said pattern.

10. A game comprising randomly adjustable means for establishing a pattern of different indicia and including a cube puzzle having six sides and formed of twenty-six interconnected cubies with the cubies, on each side of the cube puzzle in its initial position, being of the same color and with each side being a different color such that said pattern comprises a pattern of nine colored faces of said cube puzzle; means including a plurality of movable tiles having different indicia thereon corresponding to the indicia on the first-mentioned means, for enabling a player to duplicate said established pattern by movement of said tiles, the second-mentioned means including a tray having at least one recess formed therein containing said tiles, said tiles being of uniform dimension and said recess being dimensioned to be of greater area than all of the tiles therein by a dimension substantially equal to the area of one of the tiles whereby the tiles may slide in the recess to enable the player to adjust the position thereof to correspond to the pattern established on the first-mentioned means, and said tiles in said tray recess comprise a number greater than nine; and mask means for placement over the tray to cover all but nine of the tiles therein located within a predetermined area of the tray corresponding to the area of said pattern.

11. A game comprising randomly adjustable means for establishing a pattern of different indicia and including a container having a base and a transparent top, and a plurality of cubes therein having six faces and each face having a different color thereon such that said pattern comprises a pattern of nine colored faces, whereby, upon shaking of the container, different color patterns are established by said tiles; and means including a plurality of movable tiles having different indicia thereon corresponding to the indicia on the first-mentioned means, for enabling a player to duplicate said established pattern by movement of said tiles, the second-mentioned means including a tray having at least one recess formed therein containing said tiles, said tiles being of uniform dimension and said recess being dimensioned to be of greater area than all of the tiles therein by a dimension substantially equal to the area of one of the tiles whereby the tiles may slide in the recess to enable the player to adjust the position thereof to correspond to the pattern established on the first-mentioned means, and said tiles in said tray recess comprise a number greater than nine; and mask means for placement over the tray to cover all but nine of the tiles therein located within a predetermined area of the tray corresponding to the area of said pattern.

* * * * *

UNITED STATES PATENT AND TRADEMARK OFFICE

CERTIFICATE OF CORRECTION

PATENT NO. : 4,474,371

DATED : October 2, 1984

INVENTOR(S) : Marvin Asher Silbermintz

It is certified that error appears in the above-identified patent and that said Letters Patent is hereby corrected as shown below:

On the title page;

(73) Assignee: CBS Inc., New York, N.Y.

Signed and Sealed this

*Thirtieth* Day of *July 1985*

[SEAL]

*Attest:*

DONALD J. QUIGG

*Attesting Officer*

*Acting Commissioner of Patents and Trademarks*